United States Patent [19]

McCullough

[11] 4,148,514

[45] Apr. 10, 1979

[54] TENSION RELEASE LATCH

[75] Inventor: Thomas W. McCullough, San Francisco, Calif.

[73] Assignee: The United States of America as represented by the Secretary of the Navy, Washington, D.C.

[21] Appl. No.: 591,577

[22] Filed: Jun. 30, 1975

[51] Int. Cl.[2] ..... B66C 1/38

[52] U.S. Cl. ..... 294/83 R

[58] Field of Search ..... 294/83 R, 84 R; 24/68 R, 68 CD, 68 CT, 68 TT, 68 SK, 241 R, 241 CH, 241 P, 241 PP, 241 TC, 241 PS, 241 SL, 241 SB; 403/2, 296; 85/1 T; 285/2, 3, 4

[56] References Cited

U.S. PATENT DOCUMENTS

| | | | |
|---|---|---|---|
| 703,713 | 7/1902 | Smith et al. | 294/83 R |
| 2,128,102 | 8/1938 | Sherman | 294/86.18 |
| 2,602,513 | 7/1952 | Conrad et al. | 285/4 |
| 2,679,228 | 5/1954 | Gryce | 116/212 |
| 2,823,379 | 2/1958 | Novak | 293/83 R |
| 3,107,938 | 10/1963 | Schick et al. | 294/83 R |
| 3,110,331 | 11/1963 | Buchanan | 114/235 NS |
| 3,298,723 | 1/1967 | Damm | 294/83 R |
| 3,504,407 | 4/1970 | Dawgon | 24/241 R |

*Primary Examiner*—James B. Marbert

*Attorney, Agent, or Firm*—R. S. Sciascia; Charles D. B. Curry; Francis I. Gray

[57] ABSTRACT

A tensile load bearing device equipped with a tension bearing link which fractures at a predetermined tensile stress to allow a latch to open and release the load. The invention is designed to prevent the release point from being effected by torsional loads, bending moments, or compressive loads, and will release within a tolerance of about 4% of the desired release tension at loads up to 50,000 pounds.

9 Claims, 7 Drawing Figures

TENSION RELEASE LATCH

BACKGROUND OF THE INVENTION

1. Field of the Invention

The present invention relates to a tension release latch which releases an attached load when a predetermined tensile stress is reached, and more particularly to a tension release latch which releases a very heavy load within a narrow tolerance of the desired stress even when being simultaneously subjected to a torsion load and bending moment.

2. Description of the Prior Art

In hoisting or otherwise transferring a load from one station to another, the load force is transmitted by cable to a rigid load bearing structure which provides the actual static support. Situations arise where the load is within that of the tensile strength of the cable, yet exceeds the integral support capability of the structure and thus causes damage to such structure.

It is known in the art to attach the cable to a mechanism which releases the load at a particular stress ostensibly below that which would cause damage to the load supporting structure, with such mechanism in turn being attached to such supporting structure. It has been found with prior mechanisms that the release point could not be accurately predetermined, especially when used with heavy loads. The stress at which such mechanisms would release was further complicated and made all the more unpredictable by the effects of applied torsion transmitted by the cable and bending moments. it was also difficult to attach and disengage such mechanisms from the load bearing cable.

The present invention overcomes these difficulties by providing a release latch that is effected only by tensile stress, releases within a relatively narrow tolerance of the desired stress release point, and may be quickly and easily attached to and disengaged from the load bearing cable.

SUMMARY OF THE INVENTION

Briefly, the present invention relates to a tension release latch comprised of a tubular shaped body with a hinged latch section for receiving a load bearing cable terminal at one end and, attached to its other end, an end fitting designed to allow relatively fixed attachment of the latch to a support structure or member. The hinged latch section will support a load when locked in a closed position by a spring loaded tongue located within the latch's body.

The end fitting is connected to the latch body solely by means of attachment to one end of a dumbbell shaped tensile fracture link, the other end of the link being attached to the latch body. The link has a hollow passage running its length which slidably accommodates the shank of a trigger bolt. The male end of the trigger bolt is attached to the tongue while its head, being too wide to enter the link passage, abuts the end of the link which is attached to the end fitting.

Tension applied by an attached load is transmitted longitudinally through the tensile fracture link. When subjected to a predeterminable tension, the link fractures at its center section into two pieces and thereby permits the latch body to move away from the end fitting remaining attached to the supporting structure. This relative movement causes the trigger bolt head to pull the tongue out of engagement with the hinged latch section, allowing it to swing open and release the load.

The tonge may also be manually disengaged from the hinged latch section.

The tensile fracture link is replaceable. This capability permits the predeterminable release tension of the tension release latch to be varied, as well as allowing the repeated use of the device.

STATEMENT OF THE OBJECTS OF THE INVENTION

An object of the present invention is to provide a reliable and effective tension release latch.

Another object of the present invention is to provide a tension release latch to release a load from attachment to a load supporting structure when a specific tensile stress is reached.

A further object of the present invention is to provide a tensile release latch that provides for the release of an attached load within a relatively narrow tolerance of a predetermined, desired tensile stress.

Still another object of the present invention is to maintain a narrow tolerance with respect to a desired release tension even when the attached load is extremely heavy.

Yet another object of the present invention is to maintain a narrow tolerance with respect to a desired release tension even when the present invention is subjected to a bending moment.

Another object of the present invention is to maintain a narrow tolerance with respect to a desired release tension even when the present invention is subjected to torsional loading.

A further object of the present invention is to maintain a narrow tolerance with respect to a desired release tension even when the attached load is extremely heavy and the present invention is subjected to torsional loading.

A still further object of the present invention is to maintain a narrow tolerance with respect to a desired release tension even when the attached load is extremely heavy and the present invention is subjected to a bending moment.

Yet another object of the present invention is to maintain a narrow tolerance with respect to a desired release tension even when the attached load is extremely heavy and the present invention is simultaneously subjected to torsional loading and a bending moment.

An additional object of the present invention is to maintain a narrow tolerance with respect to a desired release tension even after the invention has been subjected to compressive loading.

Another object of the present invention is to allow a load to be quickly and easily attached to and disengaged from the invention by manual operation.

Other objects, advantages, and novel features of the present invention will become apparent from the following detailed description of the invention when considered in conjunction with the accompanying drawings wherein:

DESCRIPTION OF THE PREFERRED EMBODIMENT

Figure 1:
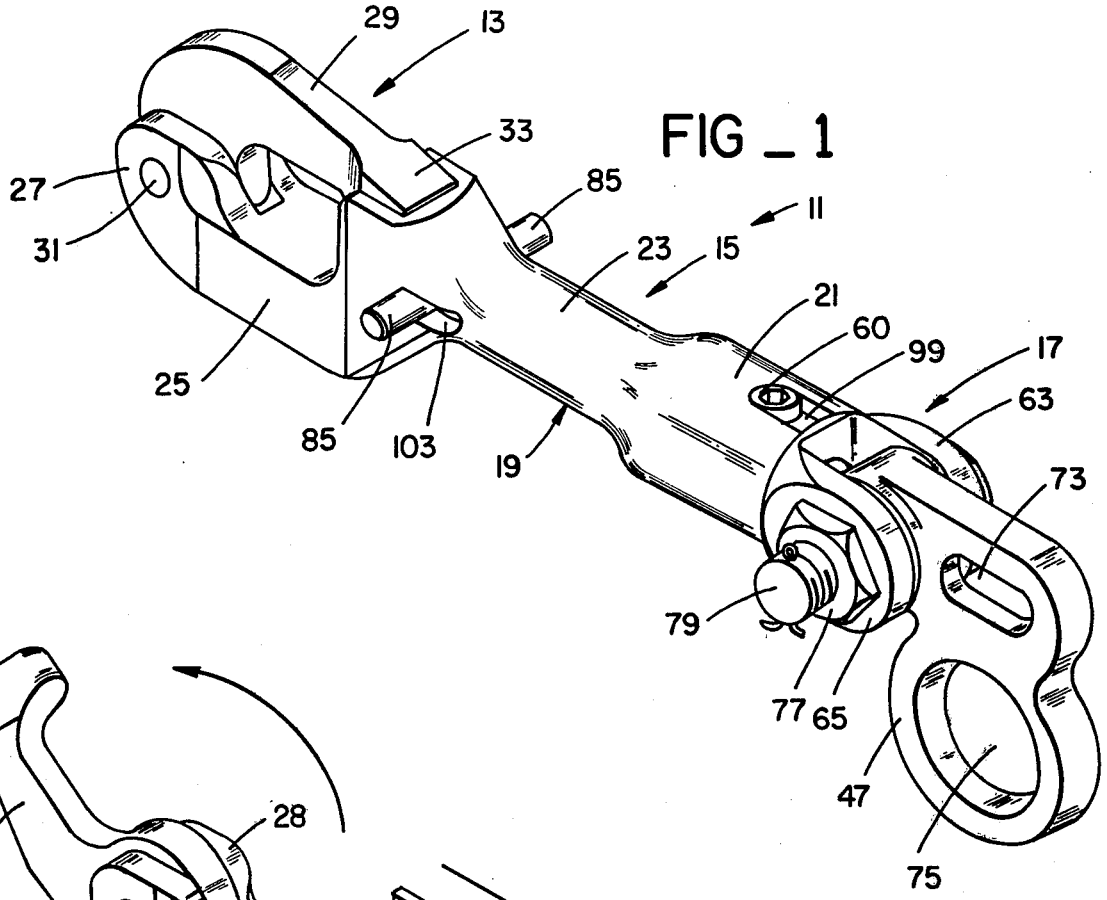
FIG. 1 is a perspective view of the latch device of the present invention showing the latch device in the locked position.
Figure 2:
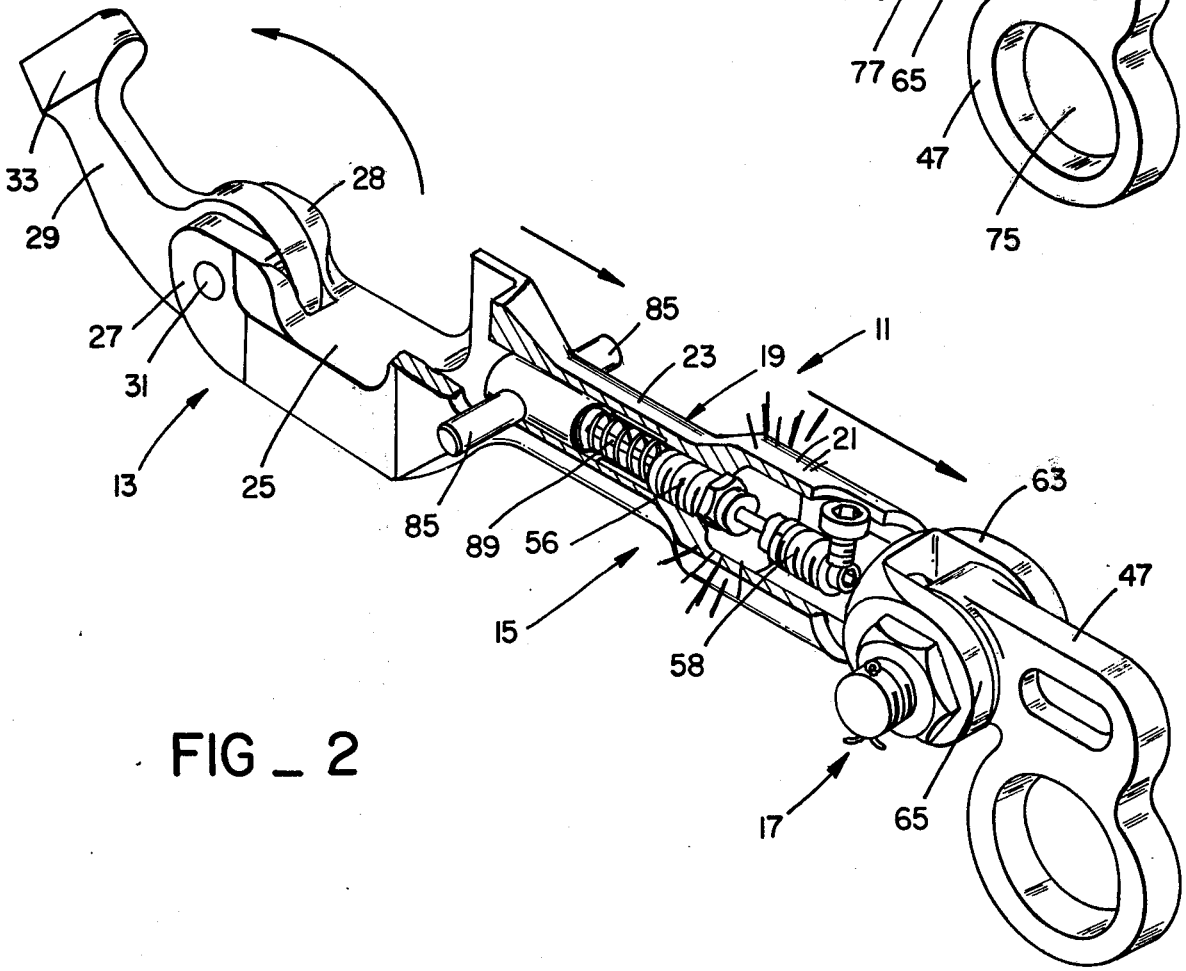
FIG. 2 is a perspective view, partly in section, of the latch device of the present invention showing the latch device in the open position.
Figure 3:
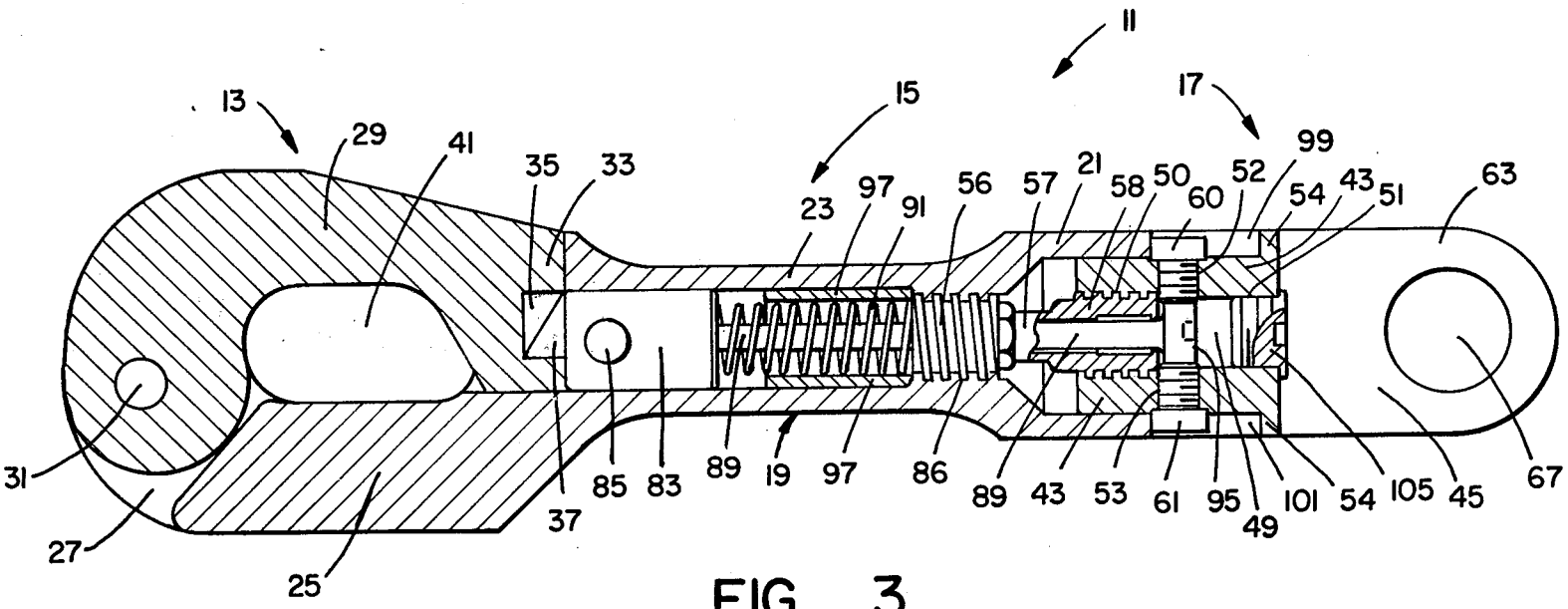
FIG. 3 is a side view, partly in section, showing the details of the latch device of the present invention.

Referring to FIGS. 1, 2, and 3, the basic elements of release latch 11 are latch section 13, latch operating section 15, and support attachment section 17. The function of support attachment section 17 is to connect latch section 13 and latch operating section 15 to a support member, not shown. The function of latch section 13 is to releaseably carry a load, not shown. The function of latch operating section 15 is to allow latch section 13 to disengage from the load when a predetermined tensile stress is exceeded.

Referring again to FIGS. 1, 2, and 3, release latch 11 includes latch body 19 comprised of a cylindrical fitting end section 21, a cylindrical control section 23, and a latch extension 25, with latch extension 25 including a pair of spaced apart extensions 27 and 28. Preferably, cylindrical fitting end section 21, cylindrical control section 23, and lower latch extension 25 are integral.

Figure 5:
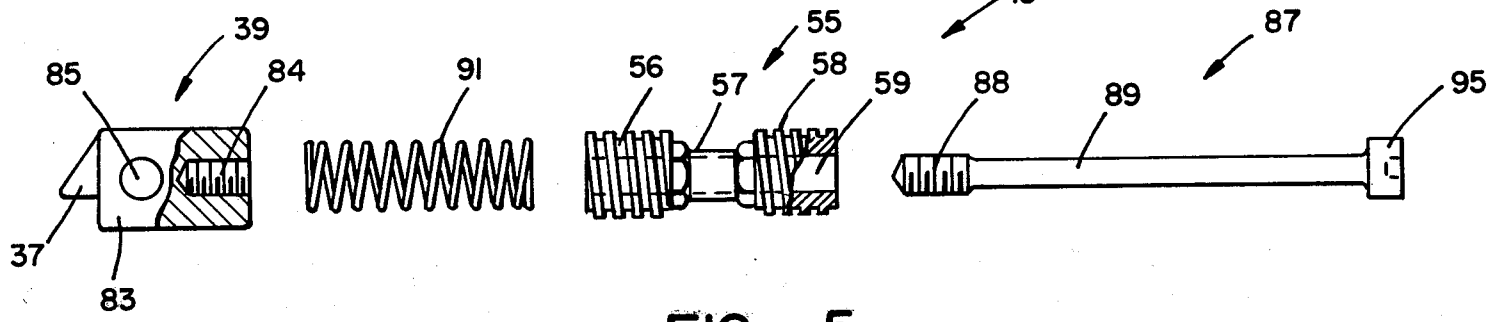
FIG. 5 is an exploded side view, partially in section, of the tongue section, coil spring, tensile fracture link, and trigger bolt used in the latch device of the present invention.

Latch section 13 includes an upper latch section 29 that has one end rotatably attached between extensions 27 and 28 of lower latch extension 25 by pin 31. The other end of latch section 13 includes an engagement section 33. Referring to FIGS. 3 and 5, engagement section 33 includes an indentation 35 that receives tongue 37 of tongue section 39, henceforth described in detail. While tongue 37 is positioned within indentation 35, upper latch section 29 is in the locked position whereby the load, not shown, that is supported within opening 41, formed by lower latch extension 25 and upper latch section 29, will remain supported by release latch 11.

When tongue 37 is withdrawn from indentation 35, uppr latch section 29 is unlocked and free to rotate counterclockwise about pin 31 as best depicted in FIG. 2. The techniques for removing tongue 37 will be hereinafter discussed in detail with respect to latch operating section 15 best shown in FIGS. 2, 3 and 5.

Referring to FIGS. 3, 4, 4A and 4B, support attachment section 17 is comprised of three sections; cylindrical section 43, adapter section 45, and flounder plate 47 (see FIGS. 1 and 2). Cylindrical section 43 includes hollow concentric opening 49 running its entire length with threads 50 and 51 formed on the inner diameter at opposite ends. Cylindrical section 43 also includes threaded cylindrical openings 52 and 53, both having centerlines lying perpendicular to the axis of symmetry of cylindrical section 43, and annular flange 54.

Support attachment section 17 also includes adapter section 45. Adapter section 45 is comprised of parallel, spaced apart extensions 63 and 65 having holes 67 and 69, respectively, which have a common centerline.

Referring to FIGS. 1 and 2, flounder plate 47 is attached to adapter section 45 by means of passing flounder plate bolt 79 consecutively through hole 67, an opening, not shown, in flounder plate 47, and hole 69, and threadedly applying nut 77 to the threaded end of flounder plate bolt 79. The supporting member (not shown) is attached to flounder plate 47 by means of a connecting rope or cable (not shown) being looped through or otherwise attached to holes 73 and 75 in flounder plate 47.

Referring to FIG. 3, the parts comprising latch operating section 15 are located within the hollow passage of cylindrical control section 23. Cylindrical control section 23 has opposite slots 103 on each side (see FIG. 1), contains annular sleeve 97 located within the hollow passage of section 23, and includes threads 86 formed at the right end of the hollow passage. Cylindrical fitting end section 21 of latch body 19 is provided with opposite slots 99 and 101 (see FIGS. 1 and 3).

Referring to FIGS. 3 and 5, latch operating section 15 includes tongue section 39, coil spring 91, tensile fracture link 55, and trigger bolt 87. Tongue section 39 is comprised of tongue 37, tongue cylinder 83, tongue cylinder opening 84, and manual release bar 85. Tensile fracture link 55 is comprised of threaded left end 56, center section 57, threaded right end 58, and concentric opening 59. Trigger bolt 87 is comprised of threaded end 88, shank 89, and head 95. The aforementioned parts are operatively positioned within the hollow passage of cylindrical control section 23 with tongue section 39 at the left end and having axial freedom of movement with the passage, and left end 56 of tensile fracture link 55 threadedly engaged with threads 86 of cylindrical control section 23 at the right end of the passage. Coil spring 91 is compressively positioned between and abutting tongue cylinder 83 on the left and the left end 56 of tensile fracture link 55 on the right. Shank 89 of trigger bolt 87 is positiond loosely within concentric opening 59 of tensile fracture link 55 and concentrically through the coil spring 91, having its end 88 threadedly engaged within tongue cylinder opening 84 and its head 95 abutting right end 58 of tensile fracture link 55. As may be seen from FIG. 3, the axial translation of tongue 37 and tongue cylinder 83 to the left is limited by the abutment of trigger bolt head 95 against right end 58 of tensile fracture link 55, and limited to the right by the abutment of tongue cylinder 83 against annular sleeve 97.

Release of upper latch extension 29 from a locked position may be manually effectuated by axial movement of manual release bar 85 to the right in slot 103 of cylindrical control section 23. This disengages tongue 37 from indentation 35 and thereby allows the counterclockwise rotation of upper latch extension 29.

Figure 4:
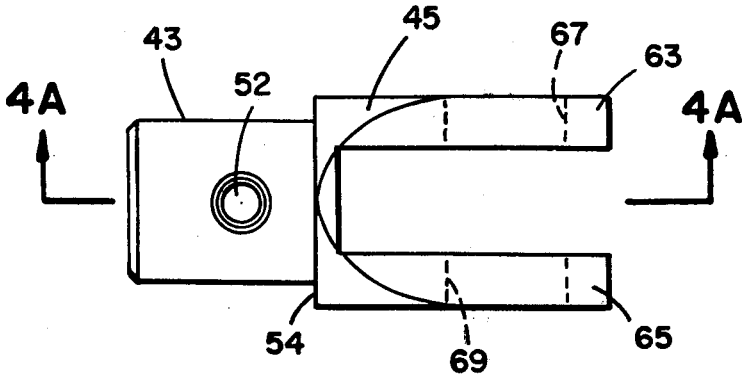
FIG. 4 is a top view of the end fitting used in the latch device of the present invention.
Figure 4B:
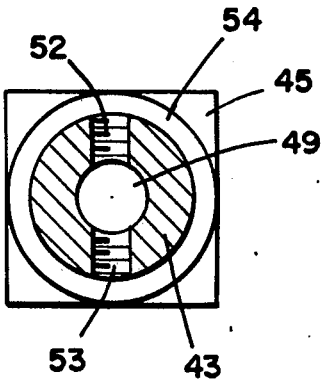
FIG. 4B is a sectional view of the end fitting used in the latch device taken at section B–B of FIG. 4.
Figure 4A:
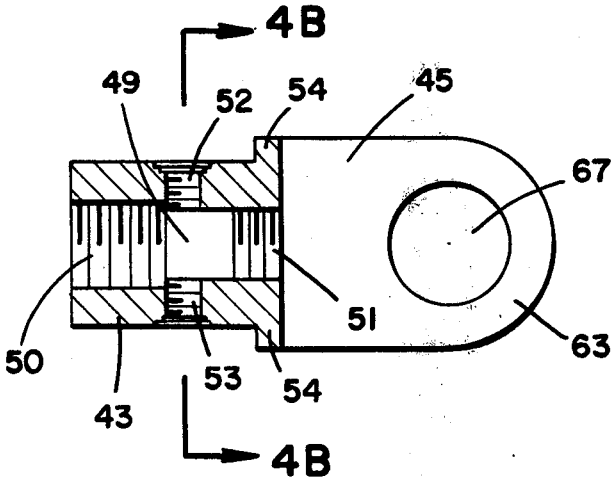
FIG. 4A is a sectional view of the end fitting used in the latch device taken at section A—A of FIG. 4.

Referring to FIGS. 3, 4A, and 5, support attachment section 17 is attached to latch operating section 15 by the engagement of threads 50 of cylindrical section 43 with the threads of right end 58 of tensile fracture link 55. Trigger bolt head 95, abutting the right end 58 of link 55, is loosely accommodated by hollow concentric opening 49 and spacing is therein provided to allow for axial translation of head 95 to the right. Cap screws 60 and 61 are respectively inserted through slots 99 and 101 (see also FIG. 1) in cylindrical fitting end section 21 and into engagement with threaded cylindrical openings 52 and 53, respectively, of cylindrical section 43. As the respective cap screw heads abut the sides of accommodating slots 99 and 101, rotation of attachment section 17 relative to latch operating section 15 is prevented. Therefore rotation which might otherwise result in the disengagement of cylindrical section 43 from the right end 58 of tensile fracture link 55 is effectively prevented. It is to be understood that under certain circumstances only one cap screw and a corresponding slot may be necessary to effect the aforementiond purpose. In an alternative embodiment several more cap screws may be provided, along with appropriately positioned slots in cylindrical fitting end section 21 and threaded cylindrical openings in cylindrical section 43, at varying angular positions to provide for different operative orientations of support attachment section 17 with respect to latch operating section 15.

Plug 105, as shown in FIG. 3, is threadedly engaged by threads 51 in concentric opening 49 to cover the exterior opening of opening 49 and thereby protect parts located in and adjoining opening 49 from exposure to corrosive elements.

In operation, when upper latch section 29 is in a locked position with a load supported within opening 41 and a supporting member is attached to flounder plate 47, latch 11 is subjected to tension generated by the load and transmits such tensile force to the attached supporting member. The design of latch 11 as hereinbefore described provides that this tensile stress is transmitted directly through tensile fracture link 55. Tensile fracture link 55 fractures at its center section 57 (thereby forming two unconnected parts) when subjected to a predetermined tensile stress. When this occurs cylindrical section 43 slides to the right and pulls with it head 95 of trigger bolt 87. It should be noted that head 95 abuts right end 58 of tensile fracture link 55 which remains in engagement with threads 50 of cylindrical section 43. Since trigger bolt 87 is connected to tongue section 39, tongue 37 is moved to the right and thereby withdrawn from indentation 35. As shown in FIG. 2, when tongue 37 is thus withdrawn the moment generated about pin 31 by the load forces upper latch extension 29 to swing open, breaking the integrity of opening 41 and thereby effectuating the release of the attached load from latch 11 and, therefore, the attached supporting member.

The force exerted by coil spring 91 on tongue cylinder 83 is intended to be only of a magnitude necessary to prevent relatively insignificant forces from causing tongue 37 to move out from indentation 35 and thereby preclude the inadvertent release of the load being carried. This opposing force of coil spring 91 is much less than the above described predetermined release force and therefore will not prevent the release of the attached load when the predetermined release load is applied.

As latch 11 remains attached to the supporting member after the release of the load, it may subsequently be used again upon replacing the fractured tensile fracture link 55. Tensile fracture links 55 of varying load capacities may be alternatively employed depending upon the load which would be sufficient to damage the supporting member connected to flounder plate 47.

Preferably, all surfaces of tensile fracture link 55 are covered with a corrosion resistant film to ensure the performance of latch 11 will not be adversely effected by possible corrosion.

It should be noted that latch 11 is specifically designed to prevent release at a specific tension from being deleteriously and unpredictably effected by the transmission of bending moments, torsion, and compressive loading to tensile fracture link 55. As best illustrated in FIGS. 3 and 5, the parts of latch operating section 15 are axially aligned to preclude the generation of a moment. Additionally, the threaded engagement between the right end 58 of tensile fracture link 55 and threads 50 of cylindrical section 43 is purposefully designed to allow some play. This play will ensure that any torsion applied through the heads of cap screws 60 and 61 will be resisted by the sides of slots 99 and 101 and not by tensile fracture link 55. As annular flange 54 axially abuts the end of cylindrical fitting end section 21, the play between the threads of end 58 and threads 50 also ensures that any axial compressive loading applied to latch 11 (for example, from dropping latch 11 onto a hard surface) will be directly resisted by section 21 of latch body 19, thereby preventing such loading from being applied to tensile fracture link 55.

What is claimed is:

1. A release latch for releasing an attached load when the tensile stress acting on said release latch exceeds a predetermined amount comprising:

(a) a hollow body having first and second ends;

(b) a latch section attached to said first end of said body for carrying a load;

(c) a means, interior to said body and attached to said second end of said body, for releasing said latch section to allow disengagement of said load from said latch section when the tensile stress upon said releasing means exceeds a predeterminable amount; and (d) a support attachment section connected to said second end of said body via said releasing means for attaching said body to a supporting member.

2. The invention of claim 1 wherein:

(a) said releasing means includes a tensile fracture link which fractures into two separate parts upon being subjected to a tensile stress which exceeds said predeterminable amount; whereby (b) said release of said latch section is effectuated.

3. A release latch for releasing an attached load when the tensile stress acting on said release latch exceeds a predeterminable amount comprising:

(a) a body having a first end and a second end;

(b) a latch section having an engagement section operatively connected thereto to carry said load, said latch section being attached to said first end of said body;

(c) means for releasing said latch section to disengage said load including a tensile fracture link which fractures into two separate parts upon being subjected to a tensile stress in excess of said predeterminable amount, said tensile fracture link having a first end connected to said second end of said body and having a second end; and (d) a support attachment section connected to said second end of said tensile fracture link for attaching said body to a supporting member so that the translational relationship of said support attachment section to said second end of said body is maintained until said tensile fracture link fractures to disengage said load.

4. A release latch as recited in claim 3 wherein said tensile fracture link further comprises a straight cylindrical link passage extending through said tensile fracture link between said first end and said second end of said tensile fracture link.

5. A release latch as recited in claim 4 wherein said releasing means further comprises:

(a) a tongue section to operatively engage said engagement section; and (b) a trigger bolt having a head with a diameter greater than the diameter of said link passage to prevent said head from entering said link passage, a shank with a length greater than the length of said link passage and a diameter less than the diameter of said link passage, and an end.

6. The release latch of claim 5 wherein:

(a) said trigger bolt shank is operatively positioned within said link passage;

(b) said trigger bolt head is operatively positioned abutting said second end of said tensile fracture link; and (c) said trigger bolt end protrudes from said first end of said tensile fracture link and is attached to said tongue section so that upon the fracture of said tensile fracture link said trigger bolt pulls said tongue section out of engagement with said engagement section of said latch section, releasing said latch section.

7. The release latch of claim 6 wherein:

(a) said body has a straight cylindrical body passage extending between said first and second ends of said body, said passage having a first opening adjacent to said first end of said body and a second opening adjacent to said end of said body;

(b) said tongue section is slidably accommodated near said first opening;

(c) said first end of said tensile fracture link is securely accommodated in said second opening;

(d) a first space in said passage is provided between said tongue section and said first end of said tensile fracture link; and (e) a second space in said support attachment section is located adjacent to said second end of said tensile fracture link.

8. The release latch of claim 7 wherein:

(a) a coil spring is compressively positioned in said first space, said coil spring having a first end abutting said tongue section and a second end abutting said first end of said tensile fracture link with said trigger bolt shank passing freely through the center; and (b) a manual release bar attached to said tongue section.

9. The release latch of claim 8 wherein said first and second spaces accommodate sufficient slidable movement of said tongue section and said trigger bolt head, respectively, to allow said tongue section to disengage from said engagement section of said latch section.

* * * * *